US011346059B2

(12) United States Patent
Radziszewski et al.

(10) Patent No.: US 11,346,059 B2
(45) Date of Patent: May 31, 2022

(54) VACUUM TUBE RAILWAY SYSTEM

(71) Applicant: Nevomo Poland Spolka Z Ograniczona Odpowiedzialnoscia, Warsaw (PL)

(72) Inventors: Pawel Radziszewski, Warsaw (PL); Lukasz Mielczarek, Lodz (PL); Grzegorz Swiatek, Siedlce (PL); Przemyslaw Paczek, Warsaw (PL)

(73) Assignee: Nevomo Poland Sp. Z O.O., Warsaw (PL)

( * ) Notice: Subject to any disclaimer, the term of this patent is extended or adjusted under 35 U.S.C. 154(b) by 0 days.

(21) Appl. No.: 17/438,191

(22) PCT Filed: Mar. 14, 2020

(86) PCT No.: PCT/EP2020/057011
§ 371 (c)(1),
(2) Date: Sep. 10, 2021

(87) PCT Pub. No.: WO2020/183027
PCT Pub. Date: Sep. 17, 2020

(65) Prior Publication Data

US 2022/0042249 A1 Feb. 10, 2022

(30) Foreign Application Priority Data

Mar. 14, 2019 (PL) ..... 429274

(51) Int. Cl.
*B61B 13/10* (2006.01)
*E01B 25/30* (2006.01)
(Continued)

(52) U.S. Cl.
CPC ..... *E01B 25/30* (2013.01); *B61B 13/08* (2013.01); *B61B 13/10* (2013.01); *E01B 1/001* (2013.01);
(Continued)

(58) Field of Classification Search
CPC ..... E01B 25/30; E01B 1/001; E01B 2204/03; B61B 13/08; B61B 13/10; E04B 1/3205;
(Continued)

(56) References Cited

U.S. PATENT DOCUMENTS 2,452,057 A * 10/1948 Kehoe ..... F16L 21/005 285/110
4,067,534 A * 1/1978 Frey ..... B29C 66/52297 285/319
(Continued)

FOREIGN PATENT DOCUMENTS

EP 3425249 A2 * 1/2019 ..... F16J 15/061
FR 2238802 2/1975
(Continued)

OTHER PUBLICATIONS

International Search Report and Written Opinion issued by the International Searching Authority, dated Jul. 20, 2020, for International Patent Application No. PCT/EP2020/057011; 13 pages.

*Primary Examiner* — Mark T Le
(74) *Attorney, Agent, or Firm* — Faegre Drinker Biddle & Reath LLP

(57) ABSTRACT

Vacuum tube railway system comprising a vacuum tube mounted on a ground support, a magnetic levitation railway track mounted inside a wall forming the vacuum tube for guiding a magnetic levitation railway vehicle, the vacuum tube assembled in sections along the ground support, at least some of a plurality of sections of vacuum tube being coupled together by a dilatation joint configured for hermetically sealing a dilatation gap between said sections of tube. The dilatation joint comprises at least first and second support plates mounted on an outer surface of the tube wall, a first support plate fixed to a first section of vacuum tube and a second support plate being fixed to a second section of
(Continued)

vacuum tube, the support plates extending longitudinally over the dilatation gap over a length (L1) greater than a maximum dilatation gap (G).

22 Claims, 7 Drawing Sheets

(51) Int. Cl.
*B61B 13/08* (2006.01)
*E04B 1/32* (2006.01)
*E01B 1/00* (2006.01)

(52) U.S. Cl.
CPC ..... *E04B 1/3205* (2013.01); *E01B 2204/03* (2013.01)

(58) Field of Classification Search
CPC ..... F16L 27/107; F16L 17/02; F16L 25/12; F16L 27/1021; F16L 27/1133; F16L 51/005; F16L 21/02; F16L 37/091
See application file for complete search history.

(56) References Cited

U.S. PATENT DOCUMENTS 4,119,334 A * 10/1978 Steed ..... B29C 65/0672 285/236
4,220,180 A * 9/1980 Koga ..... F16L 27/107 138/109
6,402,203 B1 * 6/2002 Mathiesen ..... F16L 25/12 285/224
2005/0212296 A1 * 9/2005 Dole ..... F16L 43/00 285/420
2011/0283914 A1 11/2011 Kwon
2017/0328505 A1 * 11/2017 Sith ..... F16L 37/0915
2020/0284348 A1 * 9/2020 Choi ..... G01M 3/2861

FOREIGN PATENT DOCUMENTS

KR 2016093380 A * 8/2016
KR 101830638 2/2018

* cited by examiner

VACUUM TUBE RAILWAY SYSTEM

CROSS-REFERENCE TO RELATED APPLICATIONS

The present application is a national stage entry of International (PCT) Patent Application Number PCT/EP2020/057011, filed Mar. 14, 2020, which in turn claims priority to Polish Patent Application No. P.429274, filed Mar. 14, 2019, the subject matter of which are expressly incorporated herein by reference.

FIELD OF THE INVENTION

The present invention relates to a magnetic levitation railway system. In particular applications, the magnetic levitation railway system may be integrated into an existing railway or road network.

BACKGROUND OF THE INVENTION

It is known that existing railway networks for trains on wheels may be modified to include railway tracks for a magnetically levitated train. Using an existing railway track infrastructure provides a significant advantage in reducing the costs and time for implementation, although there are some compromises needed since existing infrastructures are usually not optimized for magnetic levitation systems. Magnetic levitation systems have particularly high performance when implemented in a vacuum tube that reduces air friction and allows an increase in velocity and a decrease in energy consumption. The ease of implementation, in particular adaptation of the existing network to integrate a magnetic levitation system with minimal impact on the existing conventional railway track is an important factor. Considering that existing railway tracks may have various surfaces, ballasted or non-ballasted, adaptation to these varying surfaces along the railway line also need to be taken into account.

SUMMARY OF THE INVENTION

It is an object of the invention to provide a vacuum tube railway system with magnetic levitation that is quick and easy to install, particularly in existing infrastructures.

It is advantageous to provide a vacuum tube railway system for integration in existing infrastructures that can be quickly deployed in the existing infrastructure and that can be easily adapted to varying conditions of the existing infrastructure.

Disclosed herein is a vacuum tube railway system comprising a vacuum tube mounted on a ground support, a magnetic levitation railway track mounted inside a wall forming the vacuum tube for guiding a magnetic levitation railway vehicle, the vacuum tube assembled in sections along the ground support, at least some of a plurality of sections of vacuum tube being coupled together by a dilatation joint configured for hermetically sealing a dilatation gap between said sections of tube. The dilatation joint comprises at least first and second support plates mounted on an outer surface of the tube wall, a first support plate fixed to a first section of vacuum tube and a second support plate being fixed to a second section of vacuum tube, the support plates extending longitudinally over the dilatation gap over a length (L1) greater than a maximum dilatation gap (G), the first and second support plates being slidably mounted with respect to the other, the dilatation joint further comprising an elastic sealing layer extending over an outer side of the support plates. The sealing layer is bonded to the outer surface of the wall and extends fully over the support plates, configured to hermetically seal the dilatation gap when the pressure inside the vacuum tube is lower than atmospheric pressure.

In an advantageous embodiment, the dilatation joint further comprises a sealing membrane extending over an outer side of the support plates over a longitudinal length greater than the maximum dilatation gap, configured to prevent material of the sealing layer from entering a gap between said support plates and said dilatation gap.

In an advantageous embodiment, the sealing layer is made of an elastomeric material deposited in a fluid state in situ by a deposition process including any one or more of spraying, injecting, and depositing with layer deposing tools such as a brush or spatula.

In an advantageous embodiment, the dilatation joint may further comprise a sheet or band of elastomeric material such as rubber that is assembled on top of the support plates prior to deposition of the sealing membrane.

In an advantageous embodiment, the sealing membrane may consist or comprise of a elastomeric polymer including any one or more of polyurea, methyl methacrylate (MMA), hydrogenated nitrile-butadiene rubber (HNBR), and Fluorosilicone Rubber (FVMQ), and silicone-based elastomeric polymers.

In an advantageous embodiment, the sealing membrane is made of a sheet or band of a polymer including any one or more of polyurea, methyl methacrylate (MMA), hydrogenated nitrile-butadiene rubber (HNBR), and Fluorosilicone Rubber (FVMQ), and silicone-based elastomeric polymers.

In an advantageous embodiment, the support plates are made of a sheet of metal, HDPE, or of a fiber reinforced resin epoxy material.

In an advantageous embodiment, the support plates are attached to the wall of the corresponding vacuum tube section by an adhesive bonding.

In an advantageous embodiment, the support plates are provided in a form of bendable flat linear segments, for instance in a range of 2 to 15 meters or more, for assembly to the outer surface of the tube wall by flexibly conforming to the cross-sectional profile of the tube.

In an advantageous embodiment, the support plates have interengaging teeth, a length (L1) of the teeth being greater than the maximum dilatation gap (G).

In another embodiment, the support plates overlap each other across the dilatation gap and over an overlapping distance greater than the maximum dilatation gap (G).

In an advantageous embodiment, the vacuum tube is made of sections of length between 8-40 meters.

In an embodiment, the vacuum tube is made of prefabricated transportable sections of length between 8-18 meters, preferably of length between 12-16 meters.

In an embodiment, the vacuum tube is manufactured in situ in sections of length between 12-40 meters, preferably of length between 20-40 meters.

In an advantageous embodiment, vacuum tube sections are mounted on a ground support of an existing conventional railway track having a ballasted surface.

In an embodiment, the vacuum tube sections are mounted on existing steel rails, further comprising a deformable spacer mounted between the steel rail and the wall of the vacuum tube. A positioning rib may be fixed to an outer side of the wall of the vacuum tube and engaging an outer lateral side of the steel rail.

In an embodiment, the vacuum tube sections are mounted directly on the ballasted surface, a deformable mat positioned between the ballasted surface and wall of the tube.

In an embodiment, the tube sections are mounted on existing railway sleepers of a conventional railway track in which the steel rails have been removed, support beams or blocks being mounted between the sleepers and the tube wall.

In an embodiment, the railway system further comprises support posts buried at least partially within the ground support between existing sleepers of a conventional railway track, and supporting transverse beams configured for providing additional support or for passing obstacles, the vacuum tube being mounted on the transverse beams.

In an advantageous embodiment, the railway system further comprises a linear motor comprising a stator mounted via a coupling bracket to an inner side of the vacuum tube wall.

In an advantageous embodiment, the wall of the vacuum tube has a circular or substantially circular cross-sectional shape.

Further objects and advantageous aspects of the invention will be apparent from the claims, and from the following detailed description and accompanying figures.

BRIEF DESCRIPTION OF THE FIGURES

The invention will now be described with reference to the accompanying drawings, which by way of example illustrate embodiments of the present invention and in which.

DETAILED DESCRIPTION OF EMBODIMENTS OF THE INVENTION

Figure 1:
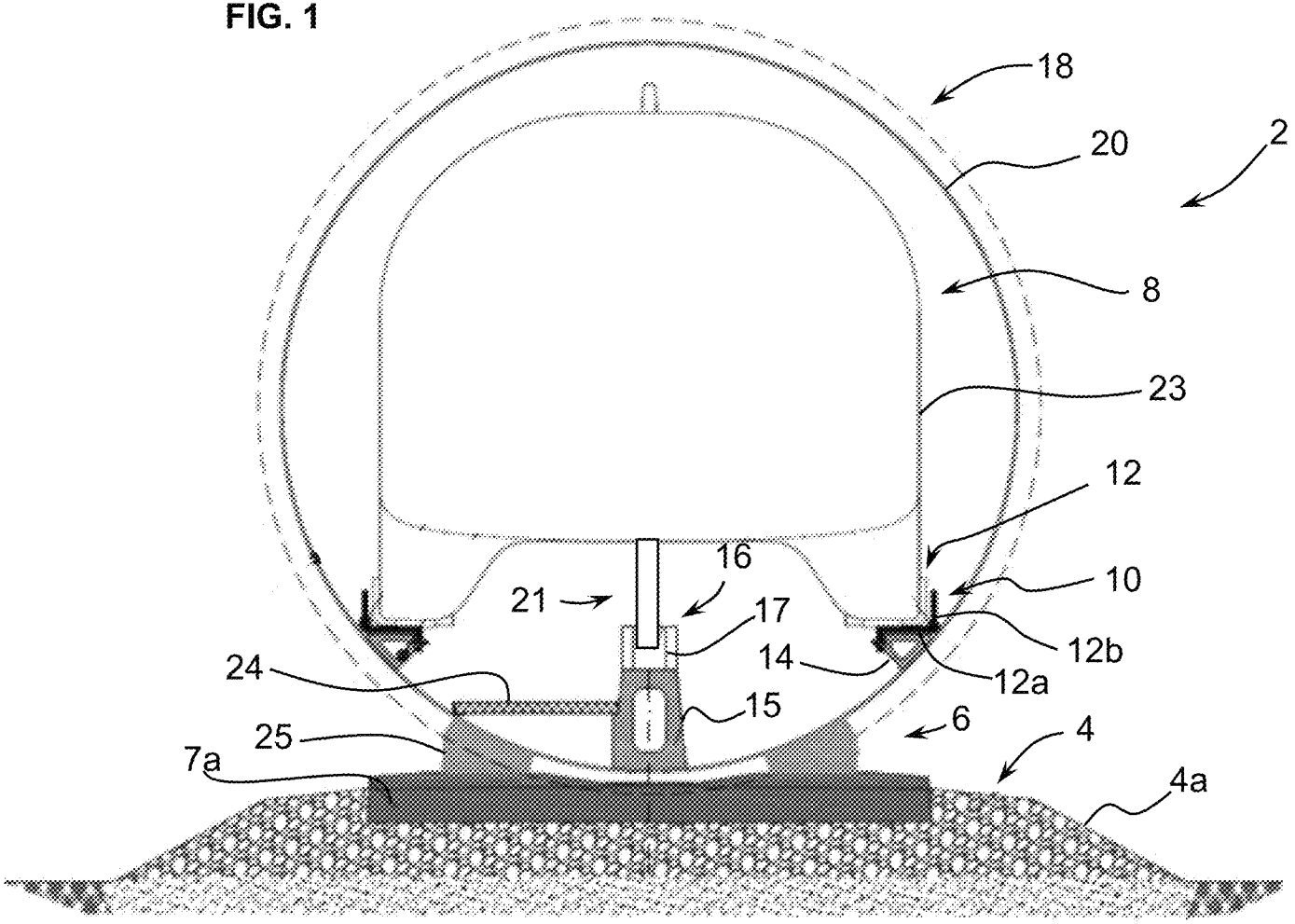
FIG. 1 is a schematic cross-sectional view through a vacuum tube railway system according to an embodiment of the invention.

Referring to the figures, a vacuum tube railway system 2 according to embodiments of the invention comprises a magnetic levitation railway vehicle 8, a vacuum tube 18 within which the railway vehicle 8 is guided, and a ground support 4 on which the vacuum tube 18 is supported. The ground support may have a ballasted surface 4*a*, in other words comprising gravel and/or stones, or may have an unballasted surface of concrete, asphalt, or other man-made surface (not shown). The vacuum tube railway system further comprises a magnetic levitation railway track 10 mounted inside the vacuum tube 18 for guiding the magnetic levitation railway vehicle 8 having corresponding levitation guide devices cooperating with the magnetic levitation rail 12.

The magnetic levitation rail 12 comprises a support rail 12*a* that supports the weight of the railway vehicle in a contactless manner during displacement of the vehicle by magnetic levitation forces as per se known in the art of magnetic levitation vehicles. The magnetic levitation rail 12 may further comprise a guide rail 12*b* to laterally position the railway vehicle. Various other configurations are possible, such as an oblique levitation rail that functions to both laterally guide and vertically support the weight of the vehicle, or to have the lateral guide separate from the weight support rail.

Coupling brackets 14 fix the magnetic levitation rail 12 to an inside of a wall 20 of the vacuum tube 18. The coupling brackets may have position adjustment mechanisms (not shown) to accurately position the magnetic levitation railway tracks with respect to each other and with respect to a linear motor 16 in order to accurately guide the railway vehicle along the vacuum tube 18.

The railway system tubes further comprises a linear motor 16 comprising a stator 17 mounted in the vacuum tube 18, and a complementary mobile element 19 mounted on the railway vehicle 8 that magnetically couples to the stator 19 for driving the railway vehicle along the track 10. The stator may be mounted to the vacuum tube wall 20 via a coupling bracket 15 allowing to adjust the position of the stator 17 relative to the magnetic levitation rails and the railway vehicle for accurate coupling thereto. The stator 17 may typically comprise coils, for instance mounted in a ferromagnetic armature, generating a magnetic field that interacts with permanent magnets or an inductive mass in the mobile element 19. In embodiments it is also possible to have an ironless stator which means that the coils are not mounted on a ferromagnetic material. The latter solution is more robust in operation and more economical despite less linear motor force. Various configurations of linear motors that are suitable for a magnetic levitation railway track are per se well-known and do not need to be further described herein. The linear motor may also be integrated in the magnetic levitation rails instead of being provided separately as illustrated, such configurations also being per se known in the art.

Within the vacuum tube, a maintenance platform 24 may be provided for maintenance workers to travel within the tube during maintenance operations.

The vacuum tube 18 preferably comprises a cylindrical or substantially cylindrical wall 20 however other cross-sectional profiles such as polygonal, square, elliptical, oval, or other non-axisymmetric shapes may be provided without departing from the spirit of the invention. A cylindrical shaped (i.e. circular cross-section) vacuum tube 18 is however in many applications likely to be the simplest, most robust shape.

The vacuum tube 18 may be made of sections of tube that may be prefabricated components each having a length allowing transport by rail or road. For instance, a section of tube may have a length in a range of 8 to 40 meters, the sections of tube being assembled one after the other along the ground support 4. Typical lengths for such tube segments are at least twice the diameter up to even 10 times of diameter of the tube, so for diameter of 4 meters the segments may be from 8 up to 40 meters. Most typically, tube sections are preferably in a range of 12-16 meters long.

Alternatively, the sections of a tube, for instance 8-40 meters long, preferably 20-40 meters long, may be manufactured on site or close to the railway track, for instance by casting concrete around a reinforcement armature. There are casting machines which for instance moving along rails to place reinforcement and cast concrete using forms or molds. Another on site tube manufacturing method comprises manufacturing on the side of the track using a stationary casting machine which produces segments which are then transported to specified parts of the track where they are mounted.

The material of the vacuum tube wall may comprise or consist of concrete, steel, or composite reinforced materials, and combinations of the foregoing.

Figure 2:
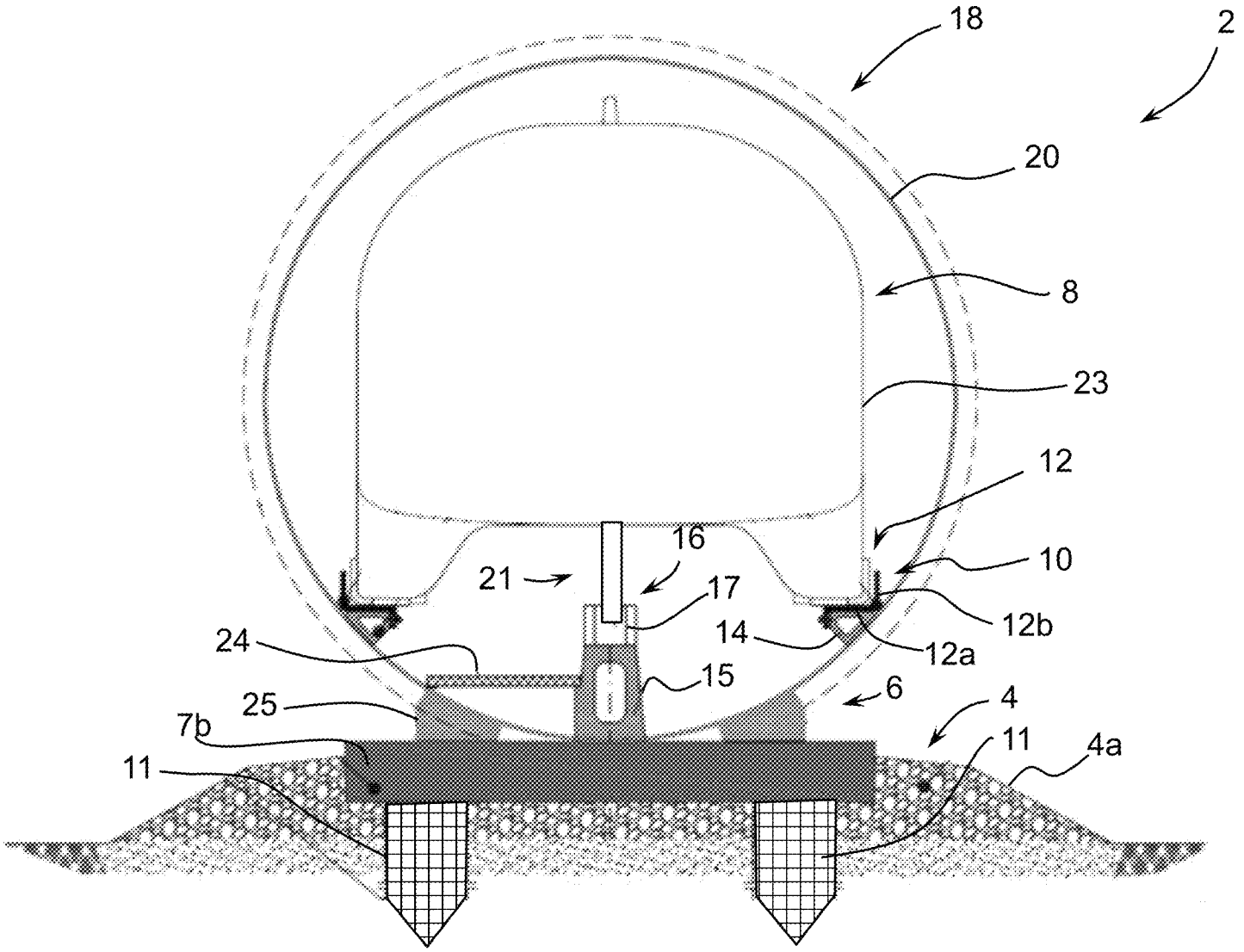
FIG. 2 is a view similar to FIG. 1 of another embodiment.
Figure 3:
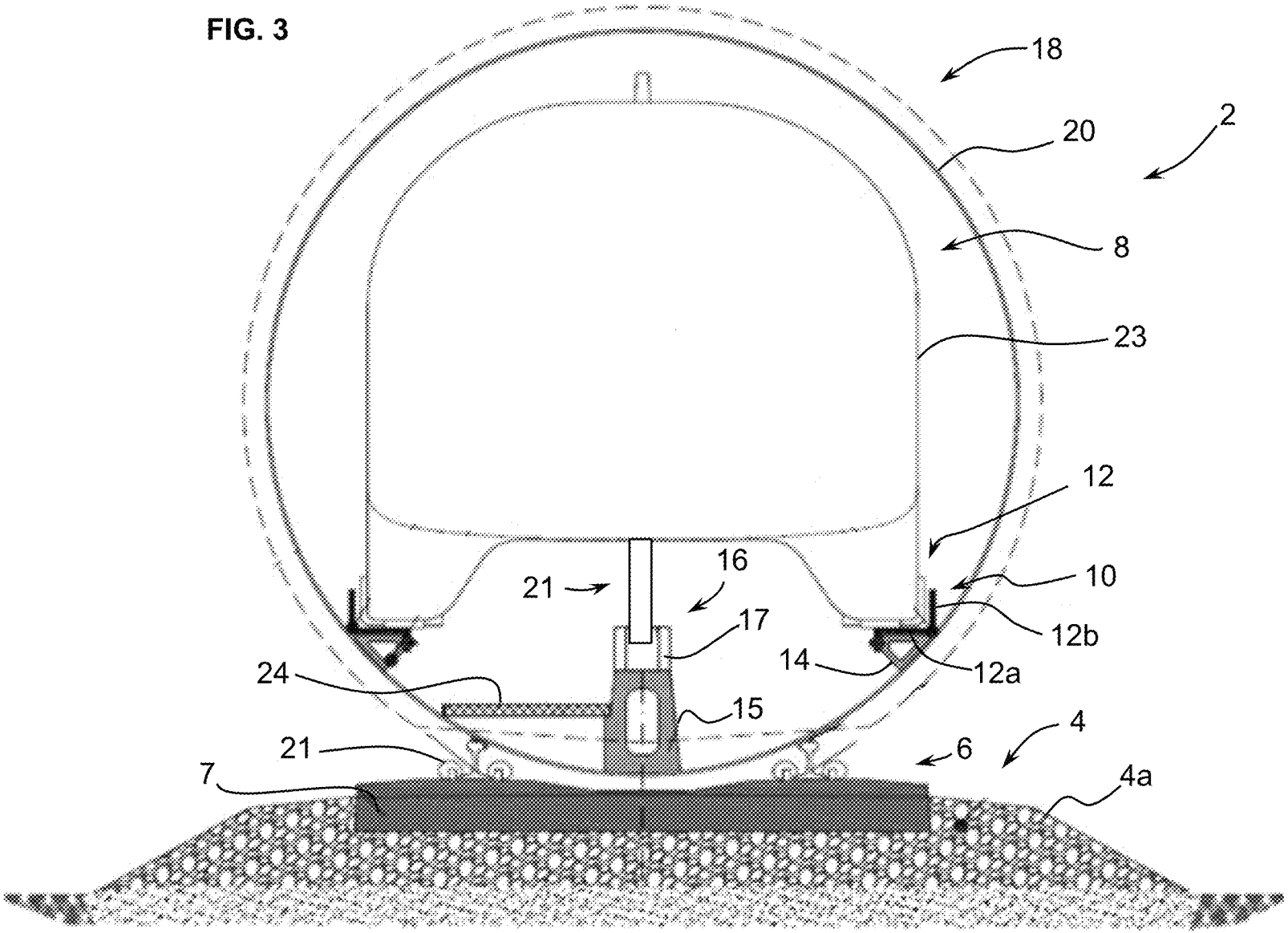
FIG. 3 is a view similar to FIGS. 1 and 2 of yet another embodiment.
Figure 3A:
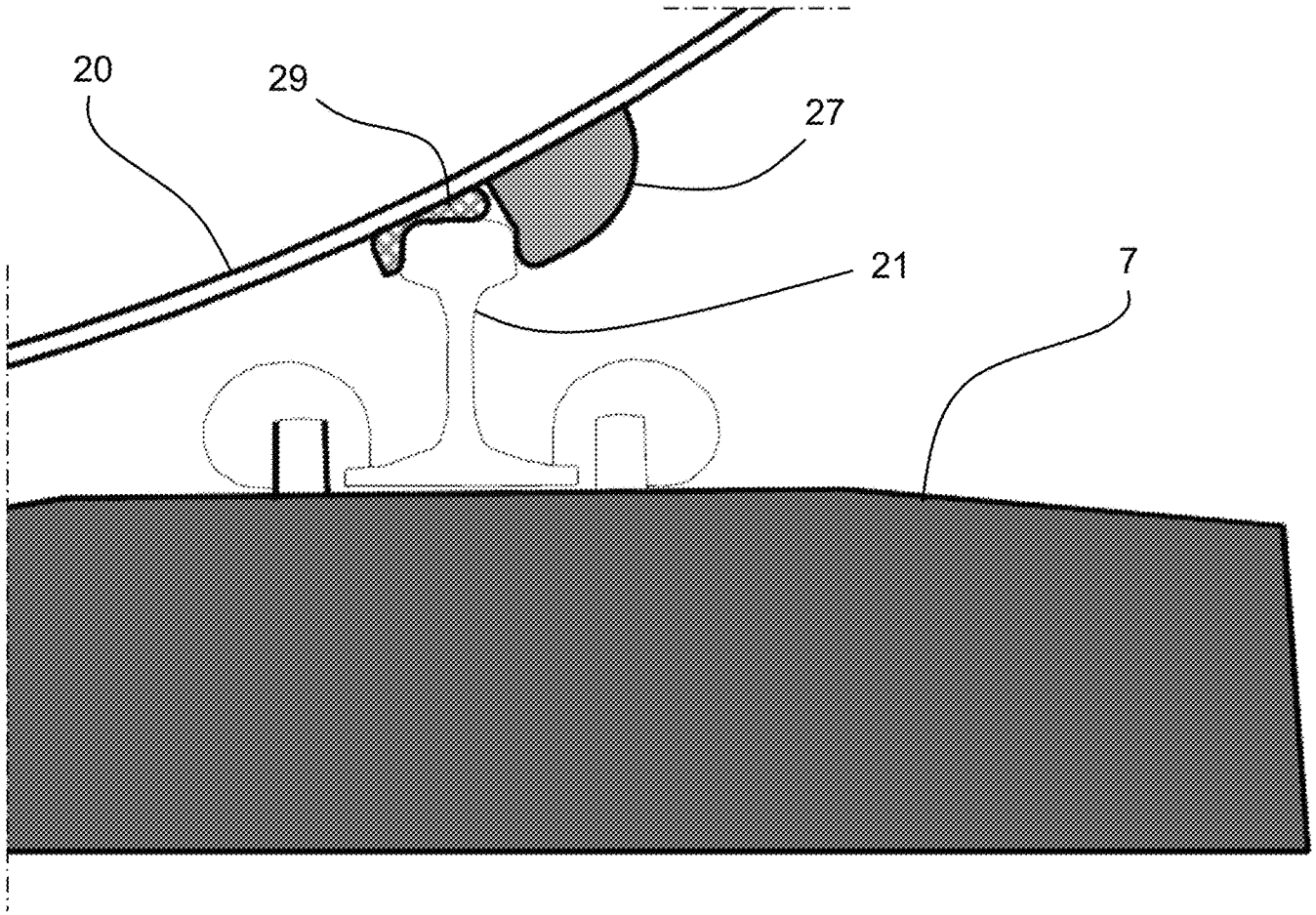
FIG. 3*a* is a detail view of a portion of the embodiment of FIG. 3, showing a coupling between a vacuum tube and an existing rail track.

The sections of the vacuum tube 18 may be mounted on an existing or newly laid ground support. The existing ground support may be designed for conventional railway vehicles, and may have rails for wheel railway vehicles as shown in FIG. 3, or without rails (for instance by removing the rails prior to installation of the vacuum tube) as shown in FIGS. 1 and 2. A tube-support interface 25 may be mounted between a fabricated support 7 such as sleepers 7*a* or transverse beams 7*b* mounted on the ballasted surface 4*a*, and the tube, to conform to the shape of the tube and accurately position the tube on the ground support. The tube-support interface may comprise support beams or blocks 25 that may be positioned individually on railway sleepers or extending longitudinally over two or more railways sleepers. The support beams or blocks are configured to conform to the outer shape of the bottom portion of the vacuum tube to securely the position of the vacuum tube with respect to the ground support 4. The support beams or blocks may be made of separate parts from the sleeper 6 and fastened thereto and may further comprise a compliant, elastomeric, or deformable layer to spread the pressure of the vacuum tube on the support beam as well as optionally damping the coupling between the vacuum tube and ground to reduce vibration and noise when a railway vehicle is running along the magnetic levitation railway track.

In the embodiment of FIG. 2, in case of ground support with insufficient carrying capability that requires greater stability, transverse beams 7*b* in addition to sleepers may be installed in the ballasted ground between sleepers and may further comprise support posts 11 that are buried and anchored into the ballasted ground support to support the transverse beams 7*b*. Such transverse beams 7*b* with support posts 11 may also be used to raise the railway tube over obstacles or to bridge across troughs.

Referring to the embodiment illustrated in FIG. 3, the vacuum tube 18 may also be positioned on existing railway tracks for conventional wheel railway vehicles. A compliant, elastic or plastically deformable spacer 29 or material may be positioned on the railway tracks in order to spread the contact pressure between the railway tracks and the vacuum tube and optionally to reduce vibration and noise when a railway vehicle is running inside the tube. The deformable spacer 29 may for instance be made of rubber or other elastomeric material, preferably reinforced with metal or composite wires or fibres. The deformable spacer may be supplied in linear segments of for instance at least 2 m up to for instance 100 m for laying on the steel rail 12 prior to lowering the sections of tube on to the rails. The tube-support interface in this embodiment may further comprise position ribs 27 for positioning and stabilization of the tube 18 on the rails 21. The ribs are configured to engage outer lateral edges of the steel rails 21. The positioning ribs may be fixed to the tube 18 in different manners depending on the material the tube wall 20 is made of, for instance by welding, adhesive bonding (e.g. Methyl methacrylate (MMA) adhesive or resin-based adhesive), or mounted using screws or anchors (in concrete). The ribs may be mounted in spacings for instance not less than 0.5 m, whereby for straight sections of vacuum tube 18 shielded from wind the spacing may be even up to 6-12 meters.

Figure 4:
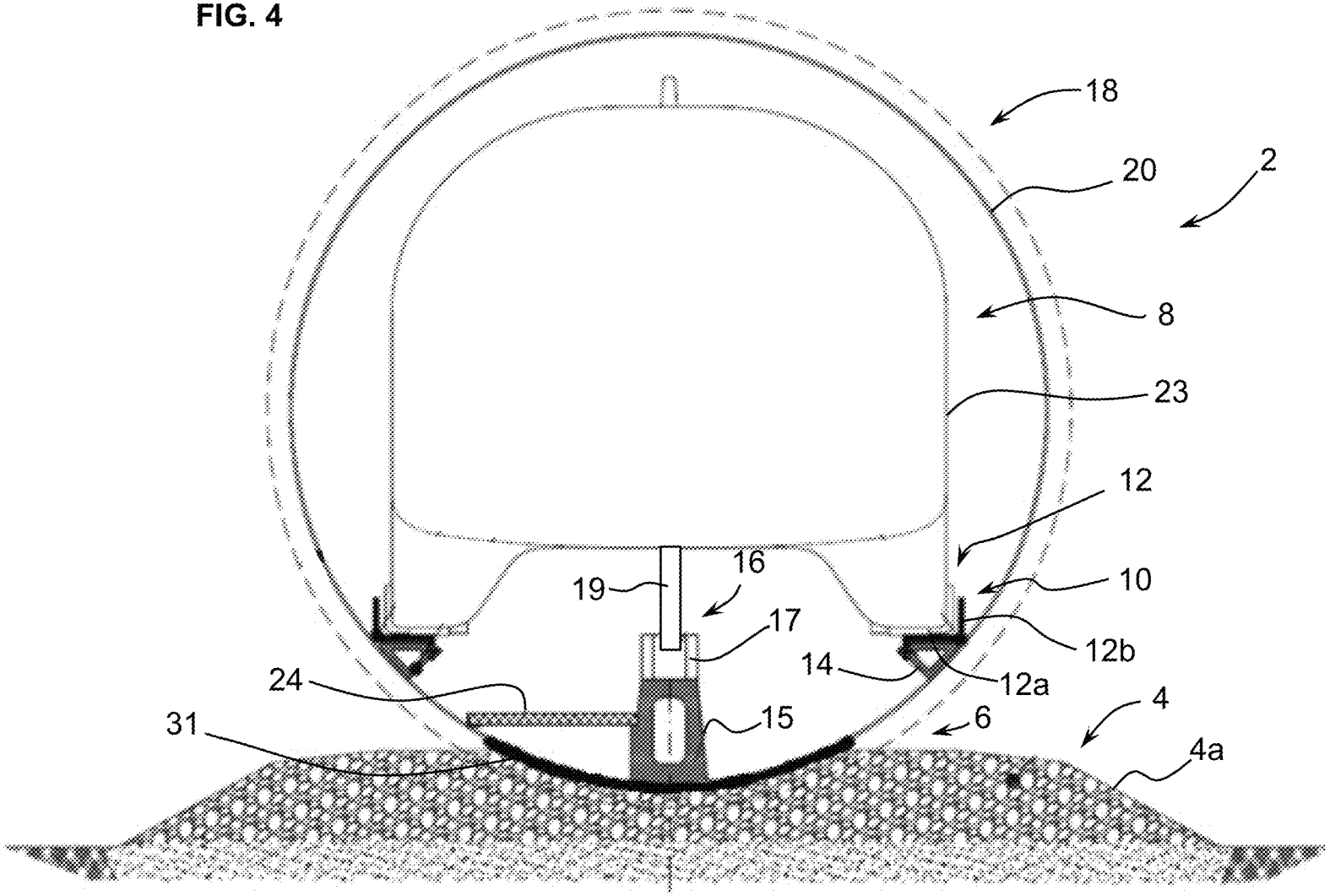
FIG. 4 is a view similar to FIGS. 1, 2 and 3 of yet another embodiment.

Referring to the embodiment illustrated in FIG. 4, the vacuum tube may also be directly mounted on ballasted support without sleepers or with the sleepers of a conventional existing railway track having been removed. A compliant, elastomeric, or plastically deformable layer of material is cast, or positioned as a mat between the contact surface portion of the vacuum tube and the ground support. The material well adapted for the latter function may include various elastomers and rubbers, polyethylene, bitumen, geotextiles or combinations of these materials.

Figure 5A:
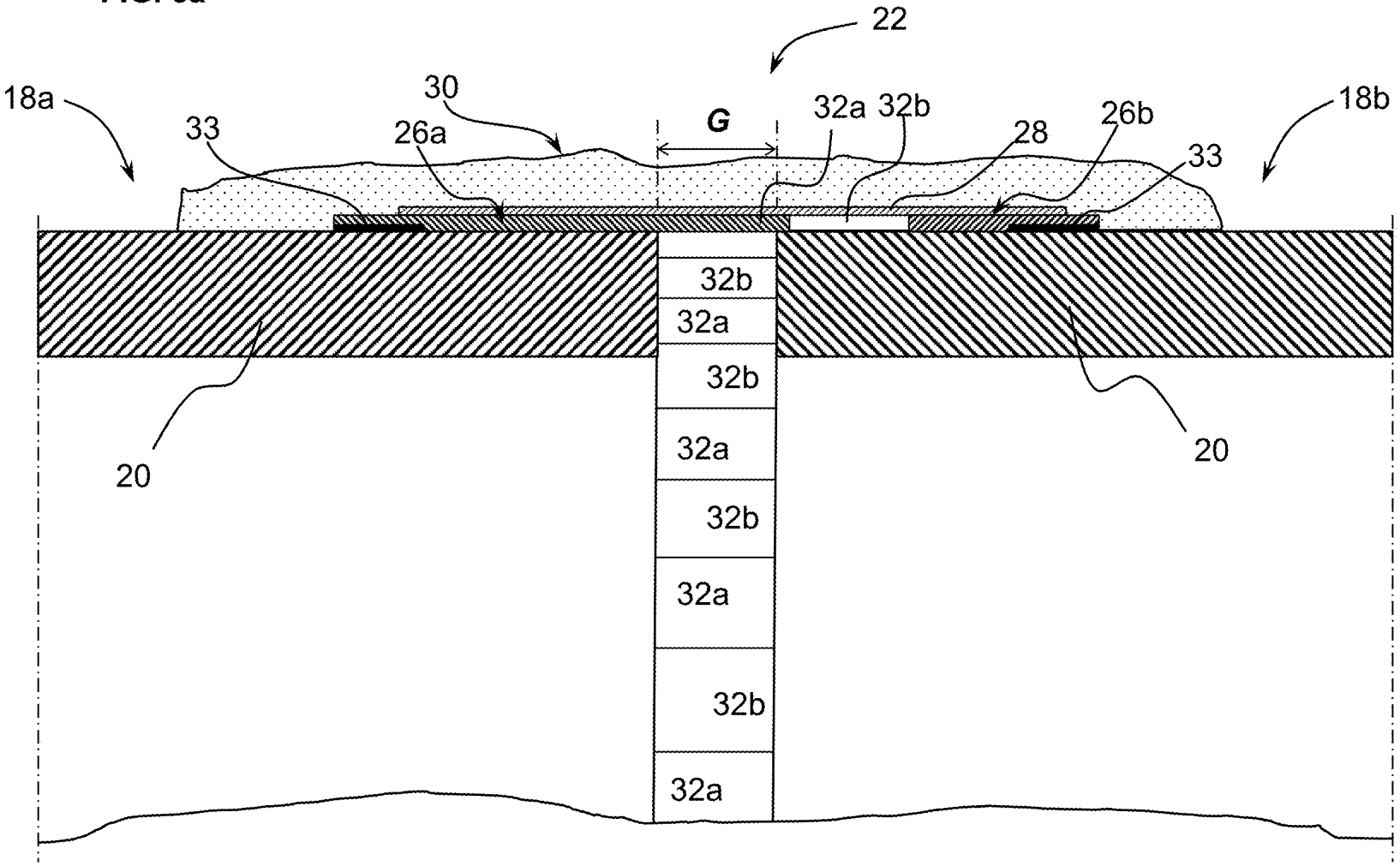
FIG. 5*a* is a schematic longitudinal sectional view of a joining interface between tubes of a vacuum tube railway system according to an embodiment of the invention.
Figure 5C:
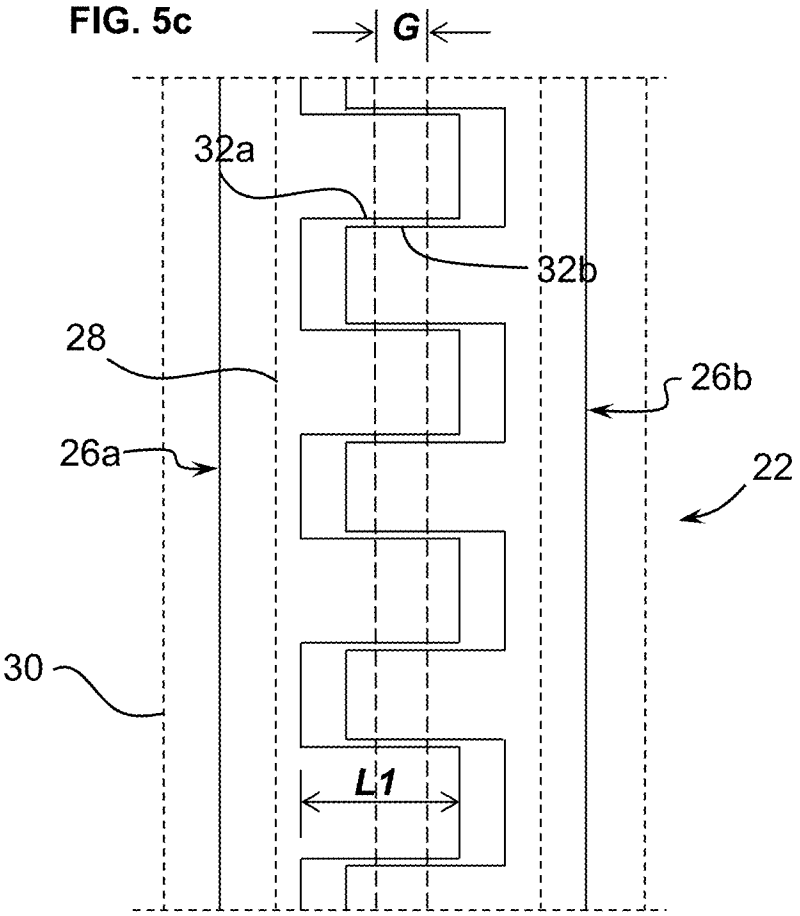
FIGS. 5*b* and 5*c* are schematic top developed views of a portion of a dilatation joint of the interface of FIG. 5*a* in an expanded (FIG. 5*b*) and contracted (FIG. 5*c*) state.
Figure 5B:
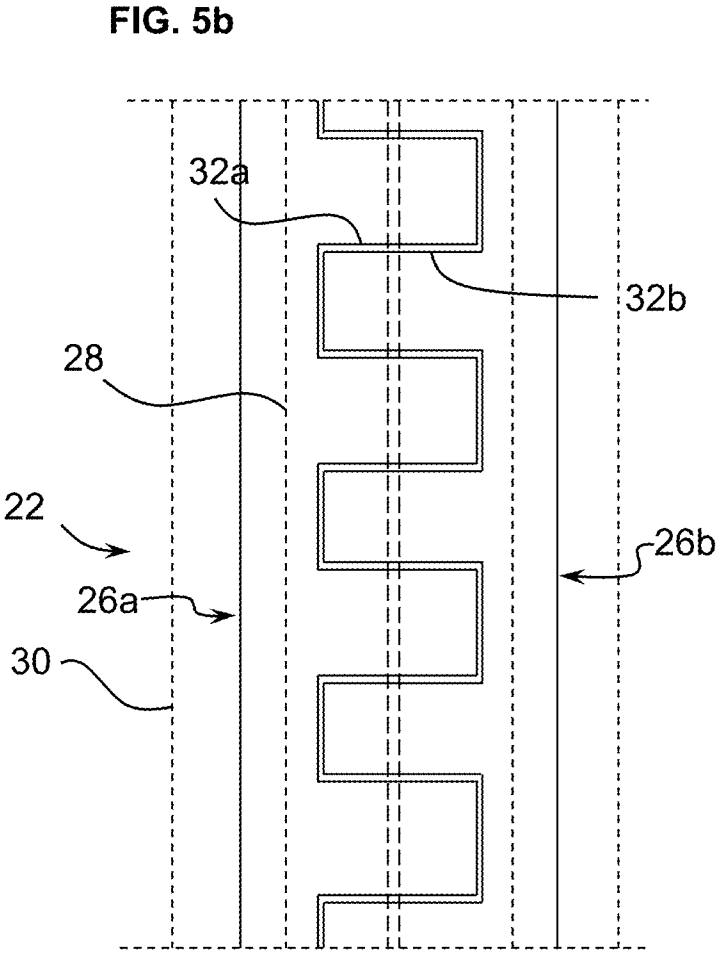

Referring now to FIGS. 5*a* to 5*c* an embodiment of an aspect of the invention is illustrated. FIG. 5*a* shows longitudinal sectional view (i.e. along a direction parallel to a centerline of the vacuum tube) of a joining interface between two assembled sections of tube. FIGS. 5*b* and 5*c* are top views of a portion of a dilatation joint of the interface in a developed (i.e. flat) state. The vacuum tubes are provided in sections of typically between 8 to 40 meters long and thus have an interface between pre-fabricated or in situ manufactured sections. Certain interfaces may be bonded together in a substantially rigid hermetic manner to form longer sections (e.g. 16 to 80 meters) that are coupled together via an interface configured to allow thermal dilatation and contraction of the tube 18 relative to the ground support 4 on which the tubes are mounted. It is necessary to be able to adjust for some dilatation between at least some sections of the tubes, not necessarily between every section but at regular intervals depending on the type of ground, and the variation in diurnal or seasonal temperatures in the location of the installation.

According to an aspect of the invention, a dilatation joint 22 is mounted on the outside of the wall 20 of the vacuum tube 20, encircling the interface. The dilatation joint ensures a hermetic sealing of the inside of the vacuum tube 18 while allowing a specified maximum amount of dilatation between adjacent sections of tube 18.

According to an advantageous embodiment, the dilatation joint comprises at least first and second support plates 26*a*, 26*b* a first support plate 26*a* being coupled to a first section of vacuum tube 18*a*, and a second support plate 26*b* being coupled to a second section of the vacuum tube 18*b* assembled to the first section. The support plates 26*a*, 26*b* may advantageously be made of a metal sheet for instance of copper, aluminium or steel sheet. The support plates 26*a*, 26*b* may also be made of a durable polymer such as High-density polyethylene (HDPE), or of a composite material, that is bonded, welded, riveted, or screwed to the corresponding section of tube in a manner to overlap the maximum interface between the juxtaposed end sections of tubes that are subject to dilatation. In a preferred embodiment, the support plates are bonded with an adhesive layer 33 to the outer surface of the tube wall 20.

As illustrated in FIGS. 5*b* to 5*c*, the support plates may be provided with interengaging fingers 32*a*, 32*b* having a length L1 that is greater than the maximum specified gap G subject to dilatation movements between the tubes 18*a*, 18*b*. The longitudinal length L1 of the fingers is thus greater than the maximum dilatation gap G for the range of operation of the vacuum tube 18. The support plate may for instance be made of a ductile material such as copper or HDPE that can be easily formed and bonded to the outside of the vacuum tube wall 20 during installation of the vacuum tube sections in situ.

In another embodiment (not shown), the support plates may be provided without interengaging fingers, but are in an overlapping relationship, the length of the maximum overlap being greater than the maximum dilatation gap G.

A sealing membrane 28 may be positioned over the support plates 26*a*, 26*b*, and in particular over the interface between the support plates such that the sealing membrane 28 extends across the dilatation gap G and beyond. The sealing membrane may advantageously comprise a very elastic polymer material such as polyurea that is capable of elastic strain in excess of 100%, for instance up to 1000%. Other sealing materials such as Methyl methacrylate (MMA) may be used. The sealing membrane may comprise a multi-layer multi-material structure, for instance an underlaying primary sealing layer made for instance of a rubber layer bonded on the outer wall, or heat shrink polymer layer, and an outer coating of a sprayed or deposited layer of elastomeric material such as polyurea or MMA.

The sealing membrane 28 covers the joint between the support plates and allows one or more sealing materials 30 to be cast, sprayed, injected, deposited or otherwise formed over the support plates 26*a*, 26*b* while preventing said sealing material from entering the gap between the support plates and from entering the gap between the ends of the walls 20. The support plates thus remain slidable with respect to each other over the maximum dilatation distance. The sealing layer 30 extends longitudinally over both ends of the respective support plates 26*a*, 26*b* and is in contact with the outer surface of the wall 20 of the vacuum tube of both sections 18*a*, 18*b* so as to provide a sealing around the support plates and sealing membrane 28. The difference in pressure between the outside of the vacuum tube and the inside creates pressure on the sealing layer 30 against the outside of the vacuum tube wall 20 to ensure a hermetic sealing. The substantially rigid support plates 26*a*, 26*b* maintain the rigidity of the sealing membrane across the maximum dilatation gap G to ensure that the vacuum tube sections 18*a*, 18*b* can move longitudinally with respect to each other without material being inserted in the dilatation gap that could get pinched therebetween to block further movement. In other words, the support plates that extend across the dilatation gap on the outer surface of the vacuum tubes ensure that the dilatation gap remains free of material and can move freely over the maximum specified dilatation distance G.

LIST OF REFERENCES

- Railway system 2
  - track ground support 4
    - ballasted (gravel, stones) 4*a*
    - unballasted (concrete, asphalt, . . . )
  - fabricated support 7
    - sleeper 7*a*
    - transverse beam 7*b*
      - support post 11
  - tube-support interface
    - support beam/block 25
    - deformable mat 31
    - deformable (elastic) spacer 29
    - positioning rib 27
  - magnetic levitation railway vehicle 8
    - levitation device
  - magnetic levitation railway track 10
    - magnetic levitation rail 12
      - guide rail 12*b*
      - support rail 12*a*
    - coupling bracket 14
  - Linear motor 16
    - coupling bracket 15
    - stator 17
      - armature
      - coil
    - mobile element 19
      - permanent magnets
      - induction plate
  - vacuum tube 18
    - wall 20
    - dilatation joint 22
      - support plates 26*a*, 26*b*
        - interengaging teeth 32, 32*a*, 32*b*
        - adhesive 33
      - sealing membrane 28
      - sealing layer 30
    - maintenance platform 24
- Maximum Dilatation Gap G (between vacuum tubes)
- Length L1 of a support plate tooth

The invention claimed is:

1. Vacuum tube railway system comprising a vacuum tube mounted on a ground support, a magnetic levitation railway track mounted inside a wall forming the vacuum tube for guiding a magnetic levitation railway vehicle, the vacuum tube assembled in sections along the ground support, at least some of a plurality of sections of the vacuum tube being coupled together by a dilatation joint configured for hermetically sealing a dilatation gap between said sections of tube, characterized in that the dilatation joint comprises at least first and second support plates mounted on an outer surface of the tube wall, a first support plate fixed to a first section of the vacuum tube and a second support plate being fixed to a second section of the vacuum tube, the support plates extending longitudinally over the dilatation gap over a length (L1) greater than a maximum dilatation gap (G), the first and second support plates being slidably mounted with respect to the other, the dilatation joint further comprising an elastic sealing layer extending over an outer side of the support plates, the sealing layer bonded to the outer surface of the wall and extending fully over the support plates, configured to hermetically seal the dilatation gap when the pressure inside the vacuum tube is lower than atmospheric pressure.

2. Vacuum tube railway system according claim 1, wherein the dilatation joint further comprises a sealing membrane extending over an outer side of the support plates over a longitudinal length greater than the maximum dilatation gap, configured to prevent material of the sealing layer from entering a gap between said support plates and said dilatation gap.

3. Vacuum tube railway system according to claim 2, wherein the dilatation joint comprises a sheet or band of elastomeric material including rubber that is assembled on top of the support plates prior to deposition of the sealing membrane.

4. Vacuum tube railway system according to claim 2, wherein the sealing membrane comprises of a elastomeric polymer including any one or more of polyurea, methyl methacrylate (MMA), hydrogenated nitrile-butadiene rubber (HNBR), and Fluorosilicone Rubber (FVMQ), and silicone-based elastomeric polymers.

5. Vacuum tube railway system according to claim 2, wherein the sealing membrane is made of a sheet or band of a polymer including any one or more of polyurea, methyl methacrylate (MMA), hydrogenated nitrile-butadiene rubber (HNBR), and Fluorosilicone Rubber (FVMQ), and silicone-based elastomeric polymers.

6. Vacuum tube railway system according to claim 1, wherein the sealing layer is made of an elastomeric material deposited in a fluid state in situ by a deposition process including any one or more of spraying, injecting, and depositing with layer deposing tools including a brush or spatula.

7. Vacuum tube railway system according to claim 1, wherein the support plates are made of a sheet of metal, HDPE, or of a fiber reinforced resin epoxy material.

8. Vacuum tube railway system according to claim 1, wherein the support plates are attached to the wall of a corresponding vacuum tube section by an adhesive bonding.

9. Vacuum tube railway system according to claim 1, wherein the support plates are provided in a form of bendable flat linear segments, for instance in a range of 2 to 15 meters or more, for assembly to the outer surface of the tube wall by flexibly conforming to a cross-sectional profile of the tube.

10. Vacuum tube railway system according to claim 1, wherein the support plates have interengaging teeth, a length (L1) of the teeth being greater than the maximum dilatation gap (G).

11. Vacuum tube railway system according to claim 1, wherein the support plates overlap each other across the dilatation gap and over an overlapping distance greater than the maximum dilatation gap (G).

12. Vacuum tube railway system according to claim 1, wherein the vacuum tube is made of sections of length between 8-40 meters.

13. Vacuum tube railway system according to claim 12, wherein the vacuum tube is made of prefabricated transportable sections of length between 8-18 meters or 12-16 meters.

14. Vacuum tube railway system according to claim 12, wherein the vacuum tube is manufactured in situ in sections of length between 12-40 meters or 20-40 meters.

15. Vacuum tube railway system according to claim 1, wherein vacuum tube sections are mounted on a ground support of an existing railway track having a ballasted surface.

16. Vacuum tube railway system according to claim 15, wherein the vacuum tube sections are mounted on existing steel rails, further comprising a deformable spacer mounted between the steel rail and the wall of the vacuum tube.

17. Vacuum tube railway system according to claim 16, further comprising a positioning rib fixed to an outer side of the wall of the vacuum tube and engaging an outer lateral side of the steel rail.

18. Vacuum tube railway system according to claim 15, wherein the vacuum tube sections are mounted directly on the ballasted surface, a deformable mat positioned between the ballasted surface and wall of the tube.

19. Vacuum tube railway system according to claim 15, wherein the tube sections are mounted on existing railway sleepers of a railway track in which steel rails have been removed, support beams or blocks being mounted between the sleepers and the tube wall.

20. Vacuum tube railway system according to claim 19, further comprising support posts buried at least partially within the ground support between the existing sleepers of the railway track, and supporting transverse beams configured for providing additional support or for passing obstacles, the vacuum tube being mounted on the transverse beams.

21. Vacuum tube railway system according to claim 1, further comprising a linear motor comprising a stator mounted via a coupling bracket to an inner side of the vacuum tube wall.

22. Vacuum tube railway system according to claim 1, wherein the wall of the vacuum tube has a circular or substantially circular cross-sectional shape.

* * * * *